US006349857B1

(12) United States Patent
Lepsius et al.

(10) Patent No.: US 6,349,857 B1
(45) Date of Patent: Feb. 26, 2002

(54) CAULKING GUN

(75) Inventors: Tilwin Lepsius, Duesseldorf; Martin Majolo, Erkelenz, both of (DE); Jos Van Den Berg, Heeswijk/Dinther (NL)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/806,724

(22) PCT Filed: Sep. 25, 1999

(86) PCT No.: PCT/EP99/07144

§ 371 Date: May 9, 2001

§ 102(e) Date: May 9, 2001

(87) PCT Pub. No.: WO00/20124

PCT Pub. Date: Apr. 13, 2000

(30) Foreign Application Priority Data

Oct. 5, 1998 (DE) ..... 198 45 685

(51) Int. Cl.[7] ..... B67D 5/42
(52) U.S. Cl. ..... 222/391
(58) Field of Search ..... 222/326, 327, 222/389, 390, 391

(56) References Cited

U.S. PATENT DOCUMENTS

| | | | | |
|---|---|---|---|---|
| 4,065,034 A | | 12/1977 | Callan | 222/146 HE |
| 5,323,931 A | * | 6/1994 | Robards, Jr. et al. | 222/391 |
| 5,368,206 A | * | 11/1994 | Dandrin | 222/326 |
| 6,082,597 A | * | 7/2000 | Beckett et al. | 222/391 |

OTHER PUBLICATIONS

Patent Abstracts of Japan vol. 018, No. 664 (C–1288), Dec. 15, 1994 & JP 06 262114 A (SANUKI:KK), Sep. 20, 1994 abstract.

* cited by examiner

*Primary Examiner*—Philippe Derakshani
*Assistant Examiner*—Thach H. Bui
(74) *Attorney, Agent, or Firm*—Wayne C. Jaeschke; Stephen D. Harper

(57) ABSTRACT

A caulking gun requiring little space when not in use is provided. The caulking gun has an elongate receiving unit for holding a cartridge containing the product to be dispensed and a handle which, when the caulking gun is being operated, extends outward in a crosswise or diagonal manner relative to the elongate receiving unit. The handle may be moved into a position substantially parallel to the elongate receiving unit when not in use.

21 Claims, 5 Drawing Sheets

CAULKING GUN

Figure 1:
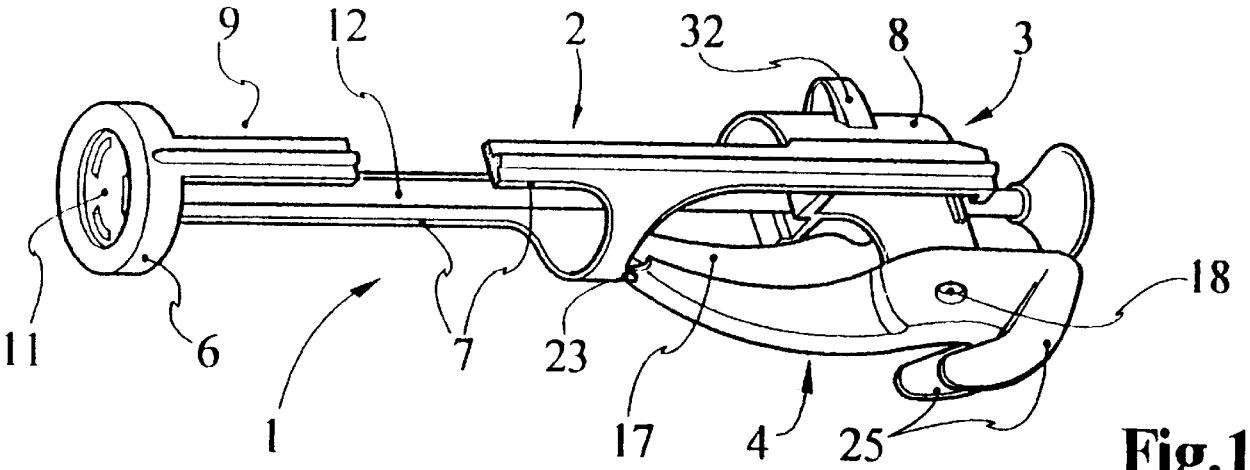

The invention relates to a caulking gun comprising an elongate receiving unit for a cartridge filled with the product to be delivered, a metering unit for the product to be delivered and a handle which in operational setting extends outwardly and transversely or obliquely relative to the elongate receiving unit.

Known caulking guns of that kind are used for expelling viscous masses, for example sealing masses for joints, from cartridges. Known caulking guns consist of the receiving unit, the metering unit and a handle fixedly connected with the receiving unit. The metering unit comprises a displaceably mounted piston rod with a piston which presses against the displaceable base of an inserted cartridge so that content of the cartridge is discharged in metered manner from the opening opposite the displaceable base. A movable, usually pivotable, operating element is connected with the handle and co-operates with the piston rod. The piston rod and thus the piston are moved by manual pressure on this operating element, so that the base of the cartridge is pushed towards the metering opening of the cartridge and the content of the cartridge is pressed out of this opening, which is usually nozzle-like.

A disadvantage of the known caulking gun is the space requirement. The piston rod can indeed be pushed into the receiving unit, but the handle extending outwardly transversely or obliquely relative to the elongate receiving unit needs a relatively large amount of space. The space requirement leads to increased transport, packaging and storage costs for the manufacturer and supplier. The need for space at the point of sale is also high. Finally, the user similarly has to have a relatively large amount of space for storage of the caulking gun when not in use.

The invention therefore has the object of substantially reducing the space requirement for a caulking gun of the kind stated in the introduction when not in use.

According to the invention this object is met in the case of a caulking gun of the kind stated in the introduction in that the handle is movable from the operational setting into a rest setting in which the handle is arranged substantially parallel to the elongate receiving unit.

In the rest setting the handle therefore needs substantially less space than in the operational setting so that the caulking gun requires considerably less room for transport, packaging and storage as well as for presentation at the point of sale.

It is within the scope of the invention for the handle to be detachably connected with the remaining parts of the caulking gun. However, so that loss of individual parts of the caulking gun is avoided and user friendliness increased, it is proposed that the handle is pivotably connected with the receiving and/or metering unit. If the metering unit comprises a displaceable piston, it is additionally proposed that the handle is pivotable about a pivot axis extending transversely to the stroke direction of the piston.

To enhance operational reliability, the handle is, in a further advantageous refinement of the invention, lockable in at least the operational setting. If the receiving unit comprises a holder for reception of the metering unit it is further of advantage if the handle comprises snap connecting members co-operating with the holder so that the handle can be locked and unlocked again in simple manner.

For improvement in user friendliness it is in addition proposed that the snap connecting members comprise two hinge arms. These hinge arms are preferably disposed on the handle in the region of the pivot axis.

It is of particularly appreciable advantage if the handle is lockable in both the operational setting and the rest setting.

In the rest setting of the handle the caulking gun can, in this case, also be handled particularly easily. For locking of the handle in the rest setting it is further proposed that the holder comprises snap connecting members co-operating with the free end of the handle. These can be provided in the form of, for example, a protruding tongue behind which the end of the handle can detent. In this way no additional parts on the handle are needed for the snap connection.

If in the case of use of conventional caulking guns the force exerted on the piston by the operating lever is relaxed, for example when the operating lever is released, then the substance disposed in the cartridge exerts a return pressure on the piston so that a locking mechanism is provided to prevent any rearward movement of the piston. The force thereby acting constantly on the cartridge piston is certainly of advantage during expulsion of the mass, but during interruption in work leads to an undesired escape of the viscous mass, which is termed "running on". Locking mechanisms of that kind are, in addition, constructionally complicated in conventional caulking guns and have to be separately operated, namely released, in order to prevent running on during interruption in work.

In an advantageous refinement of the invention it is therefore proposed that the metering unit comprises a braking device co-operating with the piston, so that from the constructional perspective a simple caulking gun with good metering characteristics is obtained. The braking device retains the piston rod during the expulsion process substantially in its position, when the operating lever is released, in order to begin a fresh pressing process. However, the braking device enables a slight rearward deviation of the piston rod in the case of interruption in work, so as to relieve the cartridge piston and in this way prevent running on. The known complicated locking mechanism can therefore be dispensed with, as the gun is automatically relieved when work is interrupted.

If the piston comprises a piston rod, the braking device preferably consists of a part of the holder tightly surrounding the piston rod at least partially.

Figure 2:
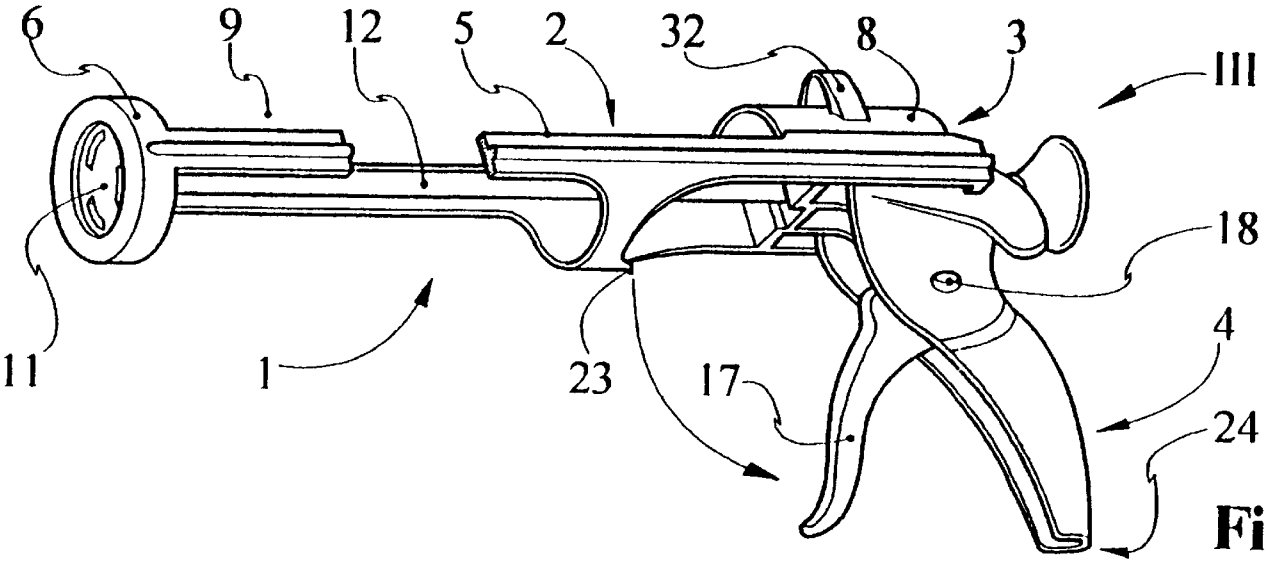
Figure 3:
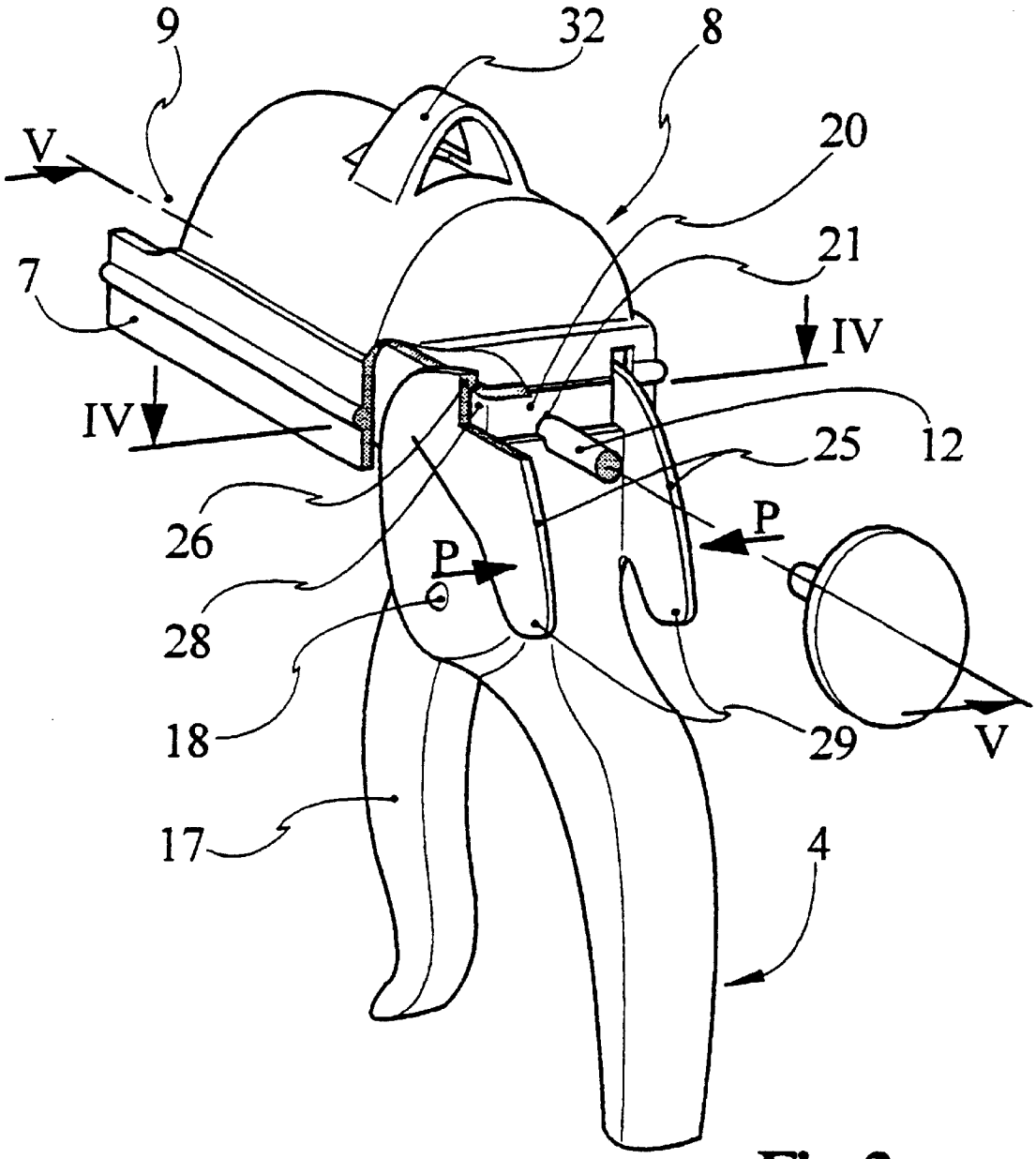
Figure 4:
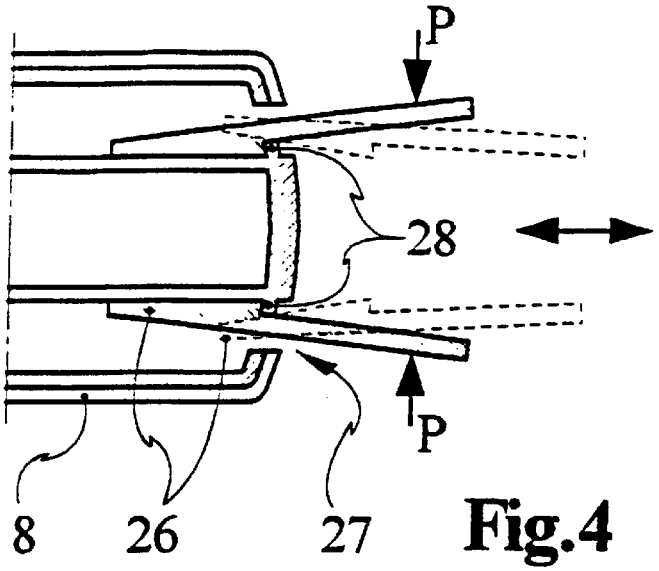
Figure 5:
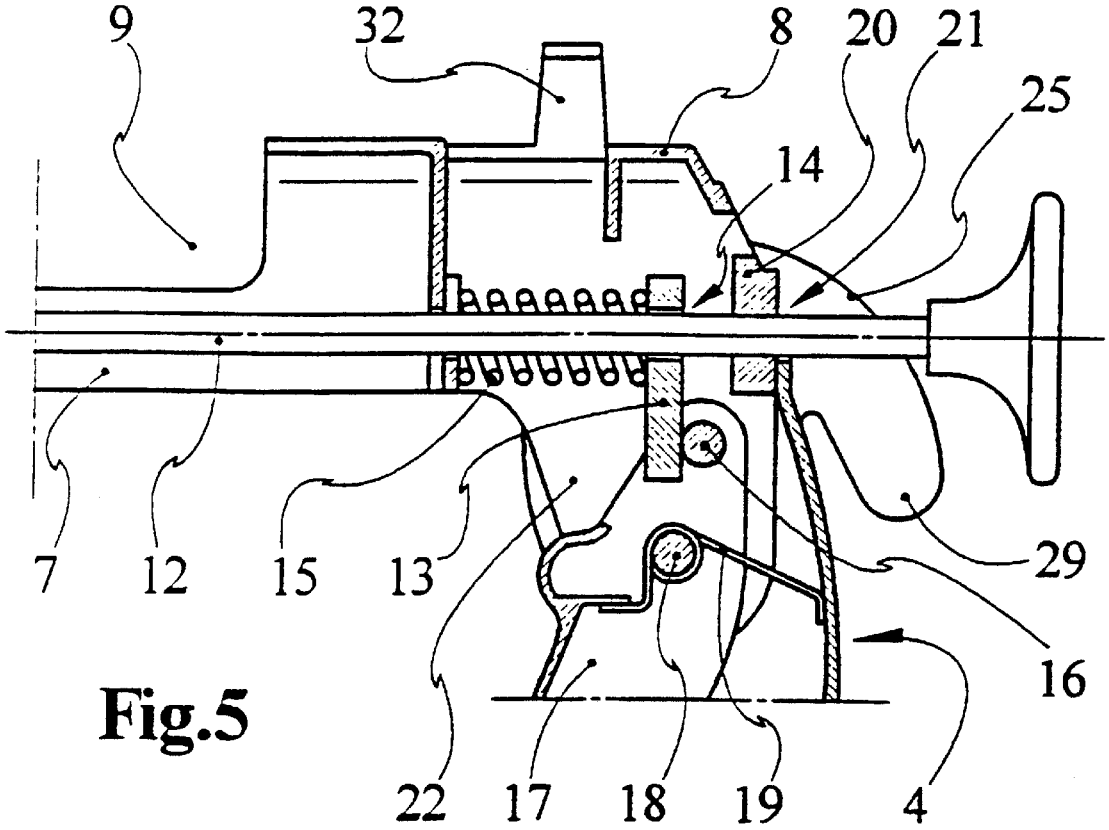
Figure 6:
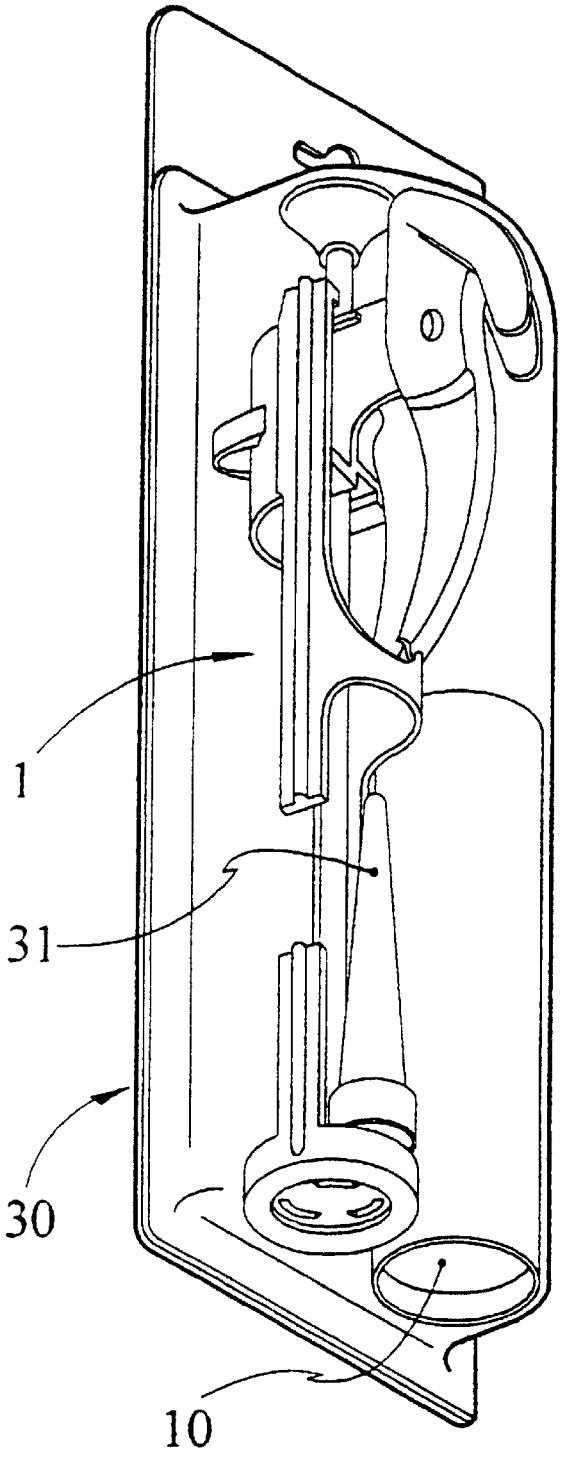
Figure 7:
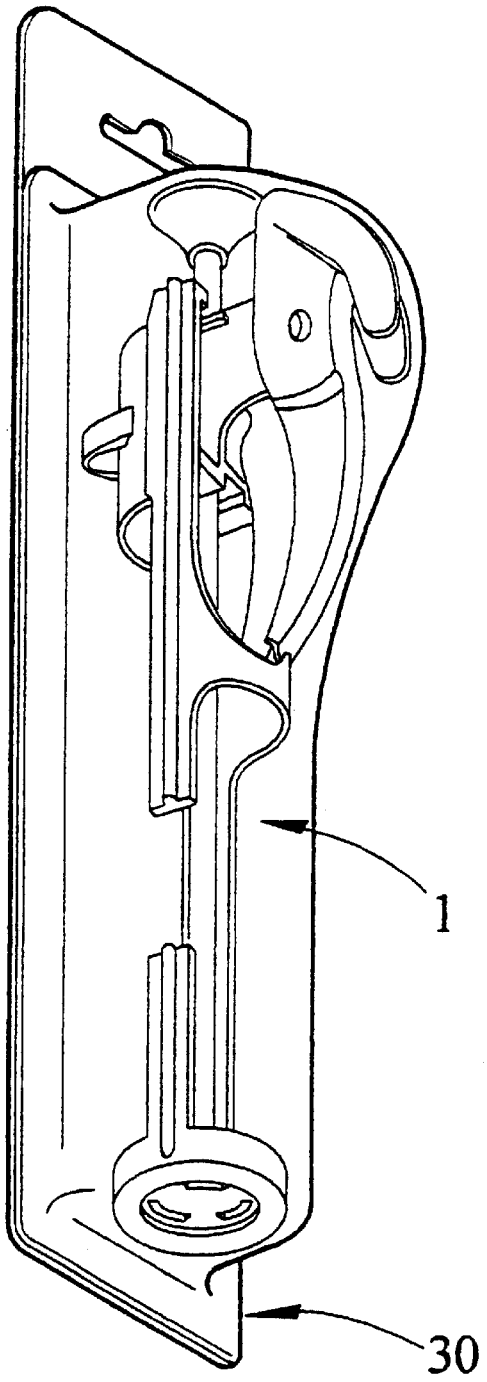
Figure 8:
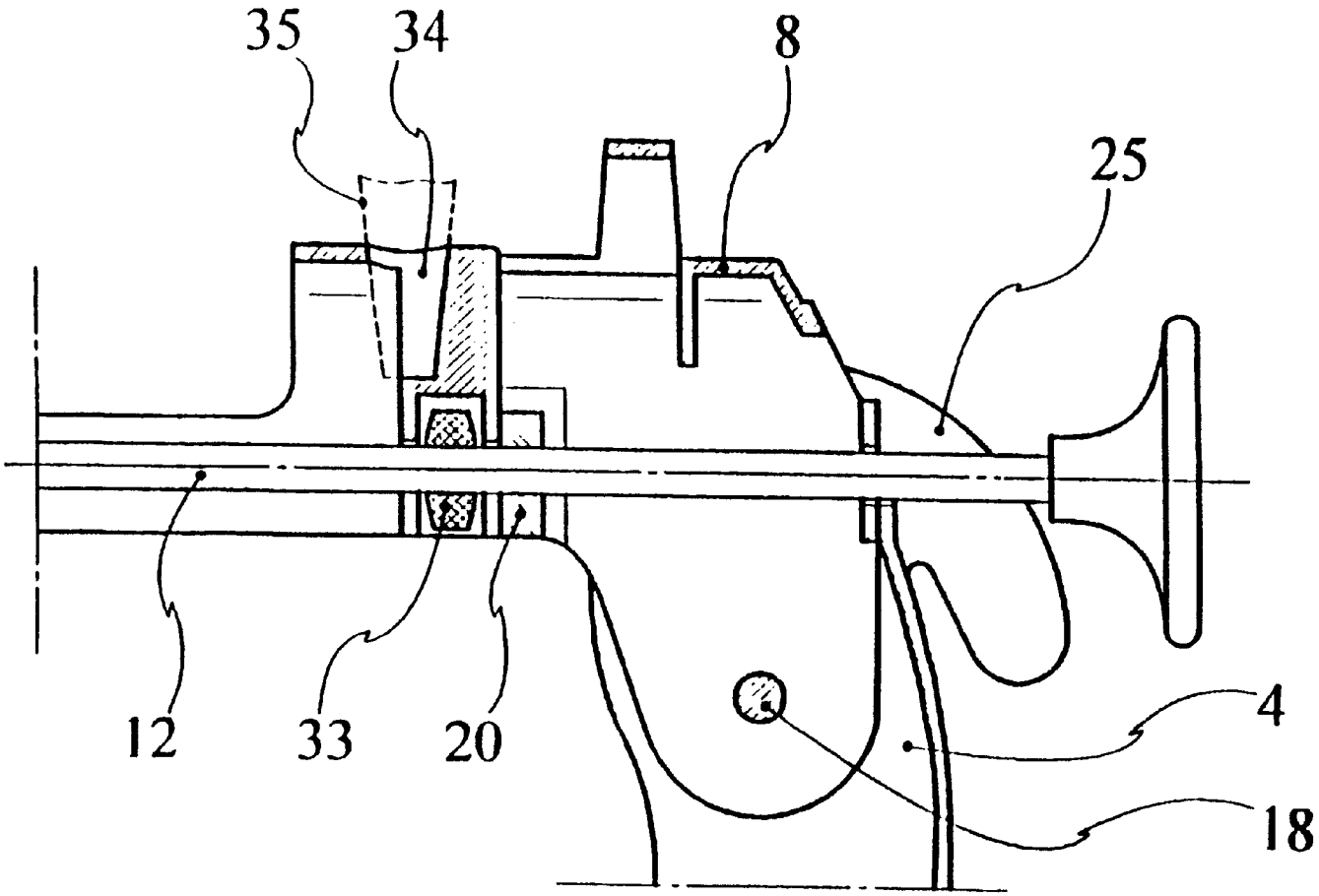

Embodiments of the invention are explained in more detail in the following by reference to drawings, in which:

FIG. 1 shows a partly broken-away perspective view of a caulking gun embodying the invention, with the handle in rest setting, FIG. 2 shows the caulking gun according to FIG. 1 with the handle in the unfolded operational setting, FIG. 3 shows the connection between the handle and the remaining parts of the caulking gun in a partly broken-away perspective detail view from the direction of arrow III in FIG. 2, FIG. 4 shows a section along the line IV—IV in FIG. 3, FIG. 5 shows a section along the line V—V in FIG. 3, FIG. 6 shows a partly broken-away perspective view of the caulking gun in a sales package, wherein the handle is disposed in the rest setting, together with a cartridge, FIG. 7 shows a packaged caulking gun according to FIG. 6, but with a cartridge packaged therewith, and FIG. 8 shows a longitudinal section through a further embodiment.

In all drawings the same reference numerals have the same significance and are therefore explained, as need be, only once.

The caulking gun 1 illustrated in the figures comprises a receiving unit 2 for reception of a cartridge, a metering unit 3 and a handle 4 connected with the receiving unit 2 and the metering unit 3, wherein this can be folded from the rest setting in FIG. 1 into the operational setting according to FIG. 2. The product to be delivered, for example a joint sealing mass, is disposed in a cylindrical cartridge 10 with a displaceable base opposite the cartridge opening (FIG. 6). The receiving unit 2 has a holder 5 with an annular front side 6, two bars 7 and a housing 8, which is located at the rear side, for receiving the metering unit 3. The holder 5 in that case encloses a space 9 for reception of the cartridge 10.

The metering unit 3 comprises a piston 11 which is mounted at the end of a piston rod 12 displaceably mounted in the housing 8. An entraining disc 13, which is tiltable in per se known manner and through the opening 14 of which the piston rod 12 projects, is in addition mounted in the housing 8 (FIG. 5). The opening 14 in that case is somewhat larger than the diameter of the piston rod 12, so that the entraining disc 13 is freely displaceable along the piston rod 12. The entraining disc 13 is pressed rearwardly by a compression spring 15. For displacing the piston rod 12, the handle 4 comprises an operating element 16 acting on the underside of the entraining disc 13. This operating element 16 is a part of an actuating lever 17 which is pivotable about an axle 18 and is held in rest setting by a torsion spring 19. Through the actuation of the operating element 17 and the forward movement of the operating element 16 the entraining element 13 is initially tipped forwardly until it presses against the piston rod 12 and is tilted there, and subsequently is pushed further forwards against the biassing force of the compression spring, whereby it moves the piston rod 12 together with the piston 11 forwardly.

In order to prevent the piston 11 and piston rod 12 from being urged back as soon as the operating lever is released and pivoted back by the force of the torsion spring 19, there is additionally located in the housing 8 a braking device 20 (FIGS. 3 and 5) which consists of a clamping plate seated on the piston rod 12 and which has an opening 21 of a diameter corresponding with the diameter of the piston rod 12. The braking device 20 thereby constantly exerts a friction force on the piston rod 12. The friction force is so low that it is overcome without difficulties when the actuating lever 17 is actuated and the piston rod 12 pushed forwards. However, the friction force is at least as great as the force applied to the piston 11 by the displaceable cartridge base, so that the piston 11 together with the piston rod 12 does not move rearwardly when the operating lever 17 is released.

According to the invention the caulking gun can be packaged and stored in a simple and problem-free manner, as the handle 4 is movable between a rest setting and an operating setting. In the present example the handle 4 can be folded together. For that purpose the handle 4 is pivotable about the same axle 18 as the operating lever 17. The pivot axle 18, which extends transversely to the stroke direction of the piston 11, is mounted in downwardly extending protrusions 22 of the housing 8 (FIG. 5). In the rest setting (FIG. 1), the handle 4 is therefore arranged adjacent and parallel to the elongate holder 5.

In the embodiment the handle 4 can be locked in both the rest setting and the operational setting. A protruding tongue 23 at the underside of the holder 5 serves for locking in the rest setting (FIGS. 1 and 3), wherein the free end 24 of the handle 4 can detent behind this tongue 23.

Snap connecting members, which are disposed at the upper side of the handle 4, serve for the locking in the operational setting (FIGS. 3 and 4). The snap connecting members consist of two hinge arms 25, the ends 26 of which are constructed to be hook-shaped. In the present example the hinge arms 25 together with the handle 4 are integrally produced from a resilient and flexible material so that they are "hinged". When the handle 4 is pivoted into the operational setting, the hook-shaped ends 26 project through openings 27 in the rearward wall of the housing 8, where they secure behind lugs 28. For unlocking of the handle 4, the free ends 29 of the hinge arms 25 are pressed together in the direction of the arrow P (FIGS. 3 and 4), so that the hook-shaped ends 26 move apart and in that case detach from the lugs 28.

Since the handle 4 is folded together, the space requirement of the caulking gun 1 when out of use is substantially smaller than in the unfolded state. Thus the advantage is achieved that a relatively small and favourably shaped packaging 30 can be used, which can be easily stacked and in addition takes up little sales area (FIGS. 6 and 7). The caulking gun can in that case be sold without (FIG. 7), but also with, one or more cartridges 10 and an injection nozzle 31 (FIG. 6). After use, the caulking gun 1 can, by folding together the handle 4, be stored in a particularly practical manner, for example by hooking an eye 32 (FIG. 3) connected with the holder 5 from a hook.

FIG. 8 shows in schematic illustration some further advantageous details of another embodiment of the caulking gun according to the invention. For the sake of clarity some parts, such as the compression spring 15 and the entraining disc 13, have been omitted in this drawing.

By contrast with the previous embodiment the clamping ring 20 is arranged more forwardly. It not only serves as a braking device, but also in operation strips off the abraded material which results from notching of the entraining disc 13 into the piston rod 12.

Moreover, a ring 33 saturated with oil is provided on the piston rod 12 and in operation provides a thin oil film on the piston rod 12. On the one hand, in this way the piston rod 12 is cleaned. On the other hand, it is protected against corrosion during storage or operation in a damp atmosphere. Due to the constant notching of the entraining disc 13 into the piston rod 12, which is usually made of iron or steel, this is very susceptible to corrosion or oxidation in, in particular, a damp atmosphere.

In addition, formed on the upper side of the housing 8 is an opening 34 into which an unused closure cap 35 of the cartridge or an unused outlet nozzle of the cartridge can be inserted so that the user does not lose it.

The invention is not limited to the described embodiment. Thus, the handle need not, for example be pivotable, but could be movably connected with the holder in a different manner. Moreover, the handle could be pivotable in a direction different from that in the present example. The handle could even be detachably connected with the rest of the caulking gun.

REFERENCE SYMBOL LIST

1 caulking gun
2 receiving unit
3 metering unit
4 handle
5 holder
6 front side
7 bar
8 housing
9 space
10 cartridge
11 piston
12 piston rod
13 entraining disc
14 opening
15 compression spring
16 operating element

17 operating lever
18 axle, pivot axis
19 torsion spring
20 braking device, clamping ring
21 opening
22 protrusion
23 tongue
24 end of the handle
25 hinge arm
26 end
27 opening
28 lug
29 end
30 packaging
31 injection nozzle
32 eye
33 ring
34 opening
35 cap

What is claimed is:

1. Caulking gun (1) comprising an elongate receiving unit (2) for a cartridge (10) filled with a product to be delivered, a metering unit (3) for the product to be delivered and a handle (4) which in operational setting extends outwardly and transversely or obliquely relative to the elongate receiving unit (2), wherein the metering unit (3) comprises a displaceable piston (11) and the piston (11) comprises a piston rod (12), the handle (4) is movable from the operational setting into a rest setting in which the handle (4) is arranged substantially parallel to the elongate receiving unit (2), the receiving unit (2) comprises a holder (5) for receiving the metering unit (3) and the handle (4) comprises snap connecting members (25, 26) co-operating with the holder (5).

2. The caulking gun according to claim 1, wherein the handle (4) is pivotably connected with at least one of the receiving unit (2) and the metering unit (3).

3. The caulking gun according to claim 2, wherein the handle (4) is pivotable about a pivot axis (18) extending transversely to the stroke direction of the piston (11).

4. The caulking gun according to claim 1, wherein the snap connecting members comprise two hinge arms (25).

5. The caulking gun according to claim 4, wherein the hinge arms (25) are disposed on the handle (4) in the region of a pivot axis (18).

6. The caulking gun according to claim 1, wherein the handle (4) is lockable in both the operational setting and the rest setting.

7. The caulking gun according to claim 6, wherein the holder (5) comprises snap connecting member (23) co-operating with a free end (24) of the handle (4).

8. The caulking gun according to claim 1, wherein the metering unit (3) comprises a braking device co-operating with the piston (11).

9. The caulking gun according to claim 8, wherein the braking device comprises a part (20), which closely surrounds the piston rod (12) at least in part, of the holder (5).

10. The caulking gun of claim 2, wherein the snap connecting members comprise two hinge arms (25).

11. The caulking gun of claim 3, wherein the snap connecting members comprise two hinge arms (25).

12. The caulking gun of claim 2, wherein the handle (4) is lockable in both the operational setting and the rest setting.

13. The caulking gun of claim 3, wherein the handle (4) is lockable in both the operational setting and the rest setting.

14. The caulking gun of claim 4, wherein the handle (4) is lockable in both the operational setting and the rest setting.

15. The caulking gun of claim 9, wherein the handle (4) is lockable in both the operational setting and the rest setting.

16. The caulking gun of claim 4, wherein the metering unit (3) comprises a braking device co-operating with the piston (11).

17. The caulking gun of claim 3, wherein the metering unit (3) comprises a braking device co-operating with the piston (11).

18. The caulking gun of claim 4, wherein the metering unit (3) comprises a braking device co-operating with the piston (11).

19. The caulking gun of claim 5, wherein the metering unit (3) comprises a braking device co-operating with the piston (11).

20. The caulking gun of claim 6, wherein the metering unit (3) comprises a braking device co-operating with the piston (11).

21. The caulking gun of claim 7, wherein the metering unit (3) comprises a braking device co-operating with the piston (11).

* * * * *